US005766091A

United States Patent [19]

Humphrey et al.

[11] Patent Number: 5,766,091

[45] Date of Patent: Jun. 16, 1998

[54] INVESTMENT CASTING OF GOLF CLUB HEADS WITH HIGH DENSITY INSERTS

[75] Inventors: J. Richard Humphrey; McNamara N. Pope, both of Salem, Oreg.

[73] Assignee: Selmet, Inc., Albany, Oreg.

[21] Appl. No.: 884,342

[22] Filed: Jun. 27, 1997

[51] Int. Cl.[6] ..... A63B 53/04

[52] U.S. Cl. ..... 473/324; 473/349; 473/338; 473/409; 164/132; 164/137; 29/530; 264/310; 427/133

[58] Field of Search ..... 473/324, 345, 473/346, 347, 348, 349, 350, 409, 338; 273/DIG. 23; 427/133, 134, 135; 164/132, 137, 517, 518, 519; 29/530; 264/310

[56] References Cited

U.S. PATENT DOCUMENTS

| | | | |
|---|---|---|---|
| 2,328,583 | 7/1943 | Reach | 473/338 |
| 5,033,530 | 7/1991 | Egoshi . | |
| 5,050,879 | 9/1991 | Sun | 473/338 |
| 5,261,478 | 11/1993 | Sun | 473/346 |
| 5,435,551 | 7/1995 | Chen | 473/342 |
| 5,499,819 | 3/1996 | Nagamoto | 473/346 |
| 5,524,698 | 6/1996 | Chen . | |

*Primary Examiner*—Sebastiano Passaniti

*Attorney, Agent, or Firm*—Chernoff, Vilhauer, McClung & Stenzel, LLP

[57] ABSTRACT

Composite golf club heads having high density inserts cast by investment casting of reactive metals such as titanium that result in a high degree of bonding between the head and the insert.

12 Claims, 2 Drawing Sheets

INVESTMENT CASTING OF GOLF CLUB HEADS WITH HIGH DENSITY INSERTS

BACKGROUND OF THE INVENTION

The use of high density inserts to improve golf club heads in various respects is well known. See, for example, U.S. Pat. Nos. 5,217,227, 5,143,571, 5,058,895 and 3,995,865. Such inserts have been used in the face of a golf club head to improve the club head's moment of inertia and to widen the "sweet spot," and on the backside and heel and toe and perimeter of the club head to improve balance and to shift the center of gravity. A variety of methods of incorporating such inserts into the club head have been used, including casting the club head with depressions designed to accept the inserts, which are then affixed to the club by adhesives, by welding, or by screws; by drilling holes in a cast club head, the holes being designed to accept the inserts; and by forming the inserts in the club head by powdered metallurgy. As an example of the last-mentioned method, there may be mentioned U.S. Pat. No. 5,217,227, which discloses a method of making a golf club head using a ceramic mold comprising filling a ceramic mold with metal powders, the mold optionally containing inserts of agglomerated metal powders, and then compressing the mold and its powdered metal contents by hot gaseous isostatic pressures on the order of 30,000 psi whereby the pressures are applied uniformly to all sides of the mold. However, drawbacks to such a method include the high cost of isostatic pressurization equipment, difficulty in obtaining desired shapes, and the method being limited to materials for which suitable powders are available.

The present invention provides an extremely efficient method of investment casting of golf club heads principally comprising a reactive metal such as titanium and containing high density inserts, whereby substantial fusion and/or interdiffusion between the inserts and the reactive metal of the club head takes place, thereby permitting greater integration between the mass of the club head and the inserts.

SUMMARY OF THE INVENTION

There are essentially two aspects to the present invention: (1) a method of making a composite golf club head containing one or more inserts; and (2) the composite golf club head made by said method.

The method comprises a unique combination of manufacturing steps, including forming a disposable pattern such as a wax pattern of a club head, the pattern including one or more inserts wherein a portion of the inserts protrude from the exterior of the pattern; forming and curing a multi-layered refractory mold around the pattern containing protruding inserts; filling the mold at ambient temperature with a molten reactive metal such as titanium, preferably by centrifugal force; then removing the protruding portions of the inserts.

DETAILED DESCRIPTION OF THE PREFERRED EMBODIMENT

According to the present invention, there is provided a method of making a composite golf club head containing at least one insert, and the golf club head produced thereby, the method comprising the steps:

(a) forming a disposable pattern of a golf club head that includes at least one insert at least a portion of which insert protrudes from the exterior of the pattern;

(b) forming a multi-layered mold around the pattern and protruding insert(s), the mold comprising at least one face coat of ceramic or metallic particles in a metallic oxide or metallic oxide-forming binder, and a multiplicity of backup layers of progressively coarser ceramic particles and a metallic oxide binder, wherein the metallic particles are selected from niobium, tantalum, molybdenum and tungsten;

(c) removing the disposable pattern from the mold, e.g., by the application of heat;

(d) curing the mold to form a refractory mold capable of withstanding the high temperatures produced by a molten reactive metal, followed by cooling the refractory mold;

(e) filling the refractory mold with a reactive metal by injecting molten reactive metal, preferably into a spinning mold, thereby forming a golf club head in the shape of the pattern that contains the protruding insert (s); followed by (f) removing the mold from the golf club head with its protruding insert(s) and removing the protruding portion(s) of the insert(s) such as by grinding.

Figure 1:
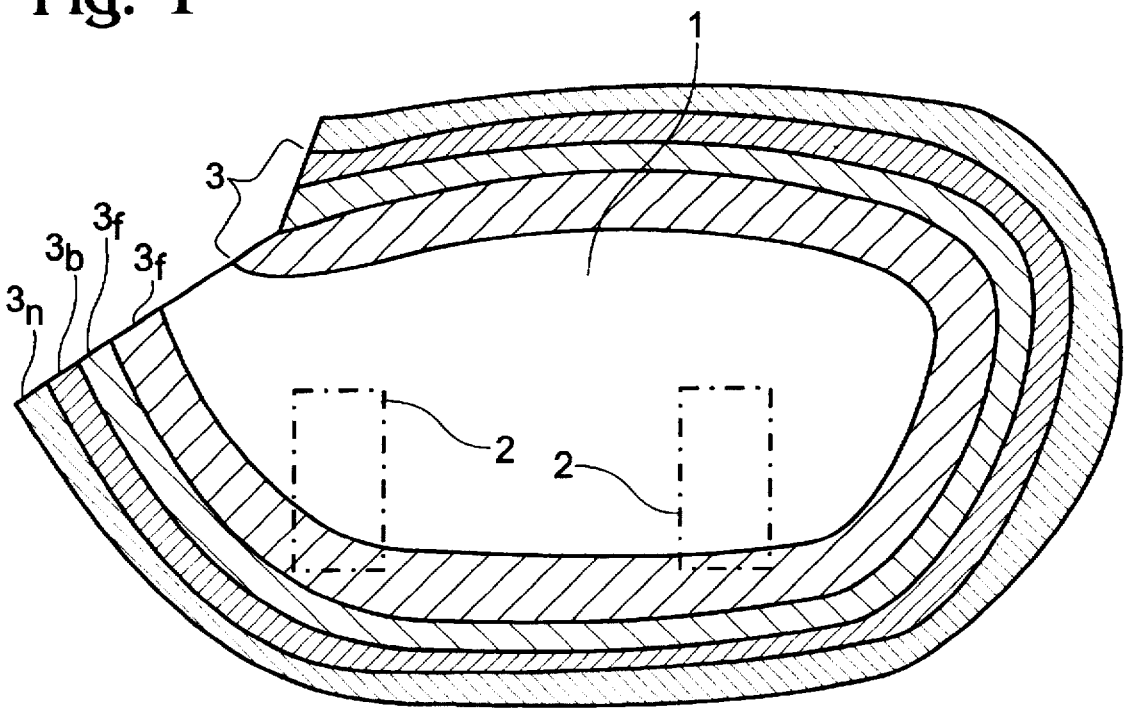
FIG. 1 is a cross-sectional view of a disposable pattern including protruding inserts, the pattern and inserts being enclosed within a multi-layered refractory mold.
Figure 2:
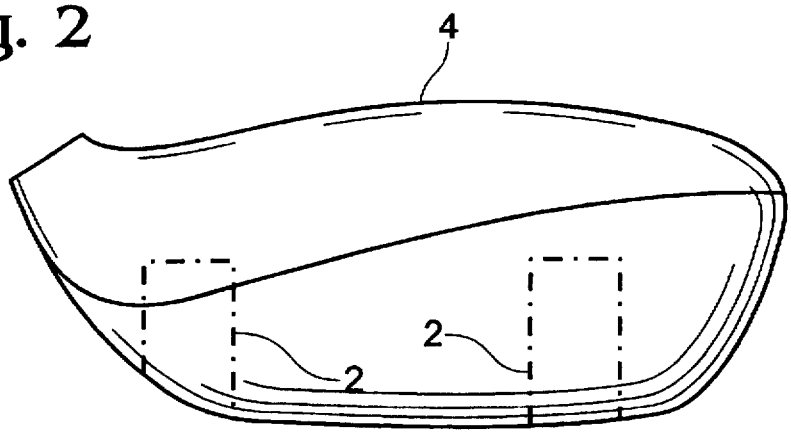
FIG. 2 is an end view of the cast golf club head resulting from the investment casting using the pattern and refractory mold of FIG. 1.

Referring to the drawings, wherein like numerals refer to the same elements, there is shown in FIG. 1 a disposable pattern 1 which may be made from waxes, plastics, frozen mercury or other materials which may readily be removed from the mold such as by dissolution or by the application of heat. At the time of formation of the disposable pattern 1, there is included within the pattern one or more high density inserts 2 oriented in the pattern 1 so that at least a portion protrudes from the exterior of the pattern. To effect either perimeter weighting and/or to improve the club's moment of inertia, the insert 2 is preferably a metal chosen such that its specific gravity or density is higher than the density of the reactive metal forming the main body of the club head. Exemplary high density metals are W, Mo, Nb, Ta, Zr and heavy metal alloys of such high density metals, wherein the heavy metals are those found in the Lanthanide and Actinide series of the Periodic Table; W and Mo are the most preferred high density metals. The protruding portion of insert 2 may be integral with the insert or may be a different, less expensive metal tapped into the insert.

The reactive metal forming the main body of the club head may be substantially pure, e.g., ≧90 wt % Hf, Ti or Zr. In an especially preferred embodiment, the reactive metal is titanium that is of a commercially pure grade, i.e., at least 98% pure containing up to 2.0 wt % other alloy metals such as Al, Cr, Fe, Mo, Sn, V and Zr, together with minor amounts of borides, oxides, nitrides and carbides of such metals and of the transition metals. When the method of the present invention is used, it has been observed that actual metal-to-metal fusion or interdiffusion or atomic bonding takes place. In this manner, the inserts are effectively integral with the main body of the club head, which is the most desirable form of incorporation of an insert into a golf club head since not even slight displacement of the insert relative to the main body of the club head takes place during the swing and at impact.

A multi-layered mold 3 is then formed around pattern 1 and protruding inserts 2, the mold comprising one or more face coats 3*f*, preferably 4 to 12 face coats of metallic particles in a metallic oxide binder wherein the particles are selected from Nb, Ta, Mo and W; and a multiplicity of backup layers 3*b*, 3*n* comprising progressively coarser particles of refractory ceramic particles such as alumina, silica or aluminum silicates and silicon oxide-forming binders. The multi-layered mold 3 is preferably formed by dipping pattern 1 into an agitated slurry of the molding material, draining it of excess slurry, then stuccoing it while still wet with refractory ceramic particles in a fluidized bed, followed by drying to a solvent content of about 2 to about 20 vol%. This sequence is repeated for both the face coat layers 3*f* and the backup layers 3*b*, 3*n* so as to produce a laminated investment shell mold of the desired thickness, strength, resiliency and permeability.

The face coat 3*f* of metallic particles in a metallic oxide binder comprises at least 50 wt % of finely divided particles of metallic Nb, Ta, Mo or W, all bonded together with up to 25 wt % of a metallic oxide binder to alter thermal conductivity and expansion characteristics; exemplary metallic oxide binders include oxides or compounds which form the oxides, of Al, Zr, Th, Hf, Yt or Gd. Compounds forming such oxides upon pyrolysis include carboxylates, metallorganic compounds, particularly the alkoxides, alcoholates, polymeric alkoxides, hydrolyzed alkoxides, halogenated alkoxides, and hydrolyzed halogenated alkoxides, all of Al, Zr, Th, Hf, Yt and Gd. Such binders are preferably used in liquid form, either dissolved or suspended or dispersed in aqueous or other liquid media, varying in viscosity between 50 and 750 cps, but preferably in the range of 200 to 450 cps. In addition, there may also be used conventional additive agents such as suspension agents, plasticizers, wetting agents, antifoaming agents, deflocculants and drying agents.

The backup layers 3*b*, 3*n* are preferably between 4 and 12 in total number, so that n preferably varies from 3 to 11. The backup layers comprise progressively more titanium-reactive materials such as aluminum silicate and silicon oxide-forming binders, and in general progressively coarser particles are used in progressively greater proportions as one moves outwardly from the disposable pattern 1, preferably varying from less coarse particles of −100+200 mesh to more coarse particles of −10+50 mesh.

It should be understood that both the proportions of coarser particles and the mesh of such particles generally form a continuum from greater proportions of finer particles starting with the first face coat layer to lesser proportions of finer particles in the outermost backup layers, and from lesser proportions of coarser particles starting with the first face coat layer to greater proportions of coarser particles in the outermost backup layers. Thus, for example, the first face coat layer may be formed of all −325 mesh particles; the second face coat of 80% −325 mesh and 20% −100+200 mesh particles; the third face coat of 70% −325 mesh and 30% −100+200 mesh particles; the first backup layer of 55% −325 mesh and 35% −100+200 mesh and 10% −20+50 mesh particles; the second and subsequent backup layers of 35% −350 mesh and 45% −100+200 mesh and 20% −20+50 mesh particles; and so on. Such a progressive increase in the sizes of particles, both in the face coatings 3*f* and the backup layers 3*b*, 3*n* and in the particles comprising the stucco material permits the fabrication of a stable investment mold capable of producing very smooth-surfaced castings, yet which is sufficiently permeable to permit venting of gases during casting and at the same time is sufficiently flexible to prevent the formation of hot tears in the casting.

Prior to curing the multi-layered mold 3, the entire assembly shown in FIG. 1 is preferably heated to fluidize and so remove disposable pattern 1 from multilayered mold 3, leaving pattern 1 invested within mold 3, together with inserts 2 properly oriented into pattern 1 and held fast in place by their protrusion into one or more layers of mold 3. Curing of the mold 3 is effected by first drying the same either in air or in a non-oxidizing atmosphere at a temperature from 35° to 250° C. for 1 to 12 hours. The molds are then preferably placed in a vacuum furnace or furnace with some other non-oxidizing atmosphere such as hydrogen, nitrogen, argon, helium, ammonia or mixtures thereof, and heated to a temperature of from about 350° to about 1200° C. at a rate of 5° to 50° C. per minute, and maintained at the peak temperature for anywhere from 1 to 12 hours, depending upon composition. Thereafter, the mold is cooled and a molten reactive metal is cast therein.

Casting may take place with the mold 3 at ambient temperature, with no preheating of the mold required, as long as the casting is conducted by centrifugal force, comprising placing one or more molds on a disk-shaped platform at regular intervals, the platform being capable of spinning at the rate of 50 to 750 rpm, or sufficient to generate a centrifugal force of from about 5 to about 100 times the force of gravity. The preferred arrangement of the casting apparatus is an electric arc-heated furnace that contains a crucible for melting and pouring the molten metals and metallic compounds into the ceramic mold, with the mold being mounted on a turntable powered by a hydraulic motor.

EXAMPLE 1

Figure 3:
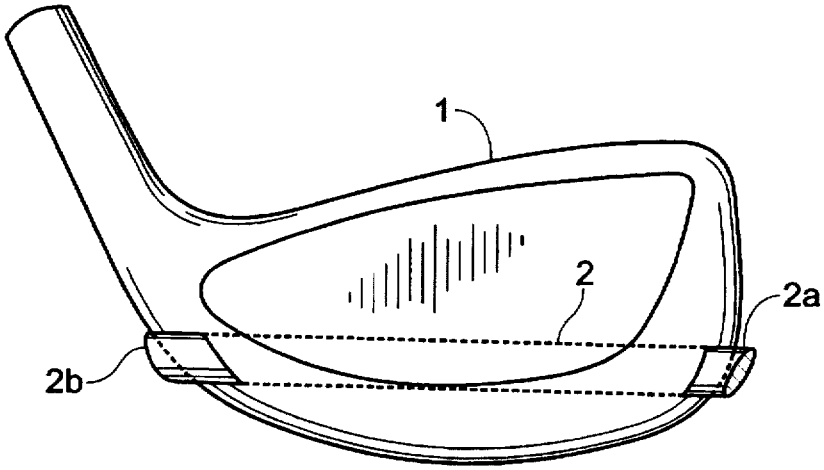
FIG. 3 is a rear view of a disposable pattern showing a protruding insert, prior to formation of a refractory mold around the pattern and protruding insert.
Figure 4:
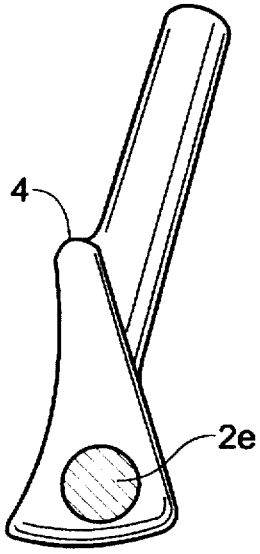
FIG. 4 is an end view of the golf club head containing insert cast from the pattern of FIG. 3 after removal of the protrusions from the insert.

A wax pattern 1 having substantially the same configuration as shown in FIG. 3 was prepared, the pattern including a tungsten insert 2 therein with the insert protruding from the pattern at 2*a* and 2*b*. The density of the tungsten insert was 19, with a melting point of approximately 3400° C. Molten 90 wt % titanium containing 6 wt % Al and 4 wt % V and having a density of 4.2 at about 1700° C. was injected into a multi-layered mold containing the protruding ends 2*a* and 2*b* of insert 2 as shown in FIG. 3 by means of the apparatus mentioned above while the mold was spinning at 400 rpm. The mold was at room temperature at the time of casting, and required no preheating.

The mold itself was formed by forming a series of slurries of the metals and metal oxides noted in the mesh sizes reported in Table 1, then successively dip coating the wax pattern containing the protruding insert into the slurries, draining the excess slurry, stuccoing the wet slurry with the same size metallic particles as used in the preceding dip coat, followed by drying the stuccoed dip coat to <20 vol% solvent (water or alcohol) to form one layer. This same procedure was repeated for each succeeding layer, with the compositions noted for each succeeding dip coat in Table 1.

After the last layer of the mold was formed, the mold containing the protruding inserts now cast into the multi-layered mold was heated to melt the wax pattern so as to remove the same, and the mold was then cured by drying the same at 230° C. in an air oven for 8hours. Finally, the mold was cured in a furnace having a controlled atmosphere comprising 97 vol% nitrogen and 3 vol% hydrogen by heating the same to a temperature of about 1200° C. at the rate of 5° C. per minute, then maintaining the furnace at the peak temperature of 1200° C. for one hour.

After the casting, the mold was removed, revealing a perfectly cast golf club head 4 in the shape of pattern 1, the golf club head having insert protrusions 2*a* and 2*b* protruding from the heel and toe portions of the club, which were then ground flush with the surface of the club to reveal the respective ends 2*e* of the insert.

TABLE 1

| Metal/Ceramic/Binder | Layer No./wt % | | | | |
|---|---|---|---|---|---|
| (mesh size) | 1 | 2 | 3 | 4 | 5-9 |
| 22 wt % $ZrO_2$ in water | 12 | 0 | 0 | 0 | 0 |
| 18 wt % $SiO_2$ (as organosilicate) | 0 | 10 | 15 | 15 | 15 |
| Tungsten (−325) | 88 | 0 | 0 | 0 | 0 |
| Alumina (−325) | 0 | 45 | 0 | 0 | 0 |
| $ZrO_2$ (−50+100) | 4 | 0 | 0 | 0 | 0 |
| Alumina (−28+48) | 0 | 45 | 0 | 0 | 0 |
| Aluminosilicate (−200) | 0 | 0 | 40 | 40 | 40 |
| Aluminosilicate (−20 to +50) | 0 | 0 | 45 | 45 | 45 |

EXAMPLE 2

Figure 5:
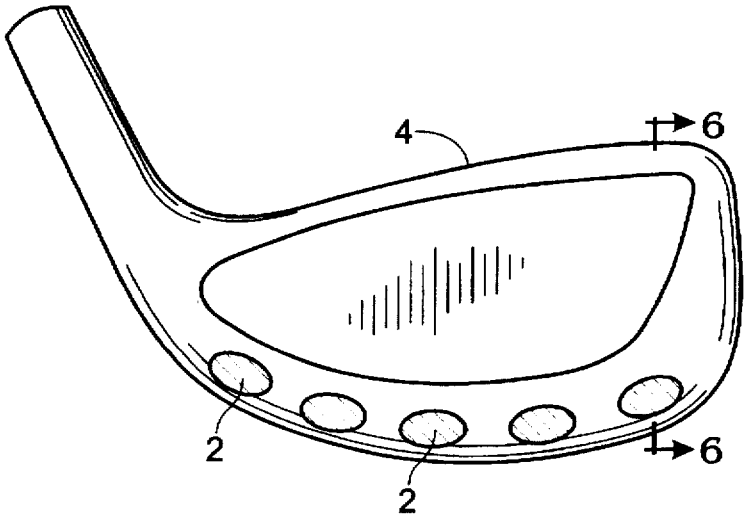
FIG. 5 is a rear view of a cast golf club head having multiple inserts to effect perimeter weighting.
Figure 6:
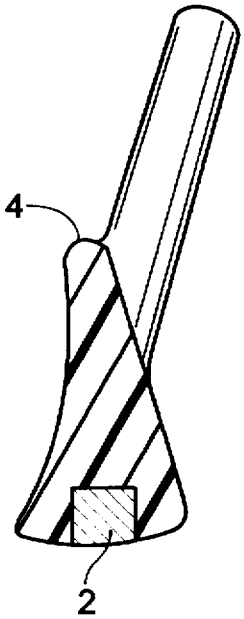
FIG. 6 is a cross-sectional view taken along 6—6 of FIG. 5.

Example 1 was substantially repeated, with the exception that a multiplicity of inserts 2 were included in the wax pattern, best seen in FIG. 5. The composition of each layer of the mold was as reported in Table 2. The club head 4 shown in FIG. 5 was cast from 99.2% pure titanium containing 0.8 wt % Al. The so-cast club was removed from the mold and bisected approximately along the plane 6—6 of FIG. 5 to reveal a cross-section as shown in FIG. 6. The interface between insert 2 and club head 4 was examined under a 50× power microscope to reveal atomic fusion or bonding between insert 2 and club head 4; the bonding was of sufficient strength that attempts to dislodge the insert with a hammer and chisel were unsuccessful.

TABLE 2

| Metal/Ceramic/Binder | Layer No. | | | | |
|---|---|---|---|---|---|
| (mesh size) | 1 | 2 | 3 | 4 | 5–12 |
| 20 wt % $ZrO_2$ in water | 12 | 10 | 0 | 0 | 0 |
| $ZrO_2$ (−50+100) | 4 | 0 | 0 | 0 | 0 |
| 18 wt % $SiO_2$ (as organosilicate) | 0 | 0 | 15 | 15 | 15 |
| Tungsten (−325) | 84 | 0 | 0 | 0 | 0 |
| Alumina (−28/+48) | 0 | 45 | 0 | 0 | 0 |
| Alumina (−325) | 0 | 45 | 0 | 0 | 0 |
| Aluminosilicate (−200) | 0 | 0 | 40 | 40 | 40 |
| Aluminosilicate (−20 to +50) | 0 | 0 | 45 | 45 | 45 |

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

We claim:

1. A method of making a composite golf club head containing at least one insert comprising the steps:

(a) forming a disposable pattern of a golf club head that includes at least one insert at least a portion of which protrudes from the exterior of said pattern so as to form at least one protruding insert;

(b) forming a multi-layered mold around said pattern and said protruding insert, said mold comprising (i) at least one face coat layer of metallic or ceramic particles and a metallic oxide binder, and (ii) a multiplicity of backup layers of progressively coarser particles and a metallic oxide binder, wherein said metallic particles in said at least one face coat layer are selected from the group consisting of Nb, Ta, Mo and W;

(c) removing said pattern from said mold;

(d) curing said mold to form a refractory mold;

(e) filling said refractory mold at ambient temperature with a molten reactive metal to form a golf club head in the shape of said pattern and containing said at least one protruding insert;

(f) removing said mold from said golf club head; and (g) removing the protruding portion of said at least one protruding insert.

2. The method of claim 1 wherein step (e) is performed by centrifugal force.

3. The method of claim 2 wherein said centrifugal force is from about 30 to about 100 times the force of gravity.

4. The method of claim 1 wherein said reactive metal is selected from the group consisting of Hf, Ti and Zr.

5. The method of claim 1 wherein said reactive metal is substantially pure Ti.

6. The method of claim 3 wherein said Ti contains ≦0.8 wt % of other metals.

7. The method of claim 4 wherein said other metals are selected from the group consisting of Al, Cr, Fe, Mo, Sn, V and Zr.

8. The method of claim 1 wherein said at least one insert has a higher density than said reactive metal.

9. The method of claim 1 wherein said at least one insert is a metal selected from the group consisting of W, Mo and heavy metal alloys of W and Mo, wherein the heavy metal in said heavy metal alloys are selected from the group consisting of the Lanthanide series and Actinide series of metals.

10. The method of claim 1 wherein step (d) is performed in two stages, the first stage being at an elevated temperature in air and the second stage being at an elevated temperature in a non-oxidizing atmosphere.

11. The method of claim 9 wherein said nonoxidizing atmosphere comprises a gas selected from the group consisting of ammonia, argon, helium, hydrogen, nitrogen and mixtures thereof.

12. A composite golf club head made by the method of claims 1, 2, 3, 5, 9 or 10.

* * * * *